US010633177B2

(12) United States Patent
Traber et al.

(10) Patent No.: US 10,633,177 B2
(45) Date of Patent: Apr. 28, 2020

(54) DEVICE FOR MANUALLY COMPACTING WASTE

(71) Applicant: Waste Allocation Systems SA, Orbe (CH)

(72) Inventors: Alexandre Traber, Lausanne (CH); Jean-Christophe Jaques, Lausanne (CH)

(73) Assignee: Waste Allocation Systems SA, Orbe (CH)

( * ) Notice: Subject to any disclaimer, the term of this patent is extended or adjusted under 35 U.S.C. 154(b) by 280 days.

(21) Appl. No.: 15/539,343

(22) PCT Filed: Dec. 22, 2015

(86) PCT No.: PCT/IB2015/059866
§ 371 (c)(1),
(2) Date: Jun. 23, 2017

(87) PCT Pub. No.: WO2016/103169
PCT Pub. Date: Jun. 30, 2016

(65) Prior Publication Data

US 2017/0362027 A1 Dec. 21, 2017

(30) Foreign Application Priority Data

Dec. 23, 2014 (EP) ..... 14199963

(51) Int. Cl.
*B30B 9/30* (2006.01)
*B30B 1/04* (2006.01)
*B65F 1/14* (2006.01)

(52) U.S. Cl.
CPC ..... *B65F 1/1405* (2013.01); *B30B 1/04* (2013.01); *B30B 9/3053* (2013.01)

(58) Field of Classification Search
CPC ..... B30B 1/04; B30B 9/3021; B30B 9/3053; B30B 9/3096; B65F 1/06; B65F 1/10; B65F 1/1415; B65B 1/24
(Continued)

(56) References Cited

U.S. PATENT DOCUMENTS

355 A * 8/1837 White ..... B30B 1/103 100/264
1,426 A * 12/1839 Price ..... B30B 9/3053 100/219
(Continued)

FOREIGN PATENT DOCUMENTS

CN 202967226 U 6/2013
DE 29922265 U1 4/2000
(Continued)

OTHER PUBLICATIONS

International Search Report; European Patent Office; International Application No. PCT/IB2015/059866; dated Mar. 4, 2016; 3 pages.

*Primary Examiner* — Jimmy T Nguyen
(74) *Attorney, Agent, or Firm* — Taft Stettinius & Hollister LLP

(57) ABSTRACT

A device for manually compacting waste, including a support plate and left-hand and right-hand lateral uprights secured to the support plate and delimiting a central space to accept a waste container. The device also includes a left-hand lever fixed pivotingly to the left-hand lateral upright about a pivot axis, and a right-hand lever fixed pivotingly to the right-hand lateral upright about a pivot axis, with the pivot axes arranged parallel to one another. The device further includes a thrust bar having a lower end fixed to a compression plate and connected to the left-hand and/or right-hand lever by a connector capable of sliding along the left-hand and/or right-hand lever to act on the thrust bar under lever action so as to move toward/away from the
(Continued)

ground to allow the compression plate to be brought closer to and respectively further away from the support plate from a position of equilibrium.

15 Claims, 8 Drawing Sheets

(58) Field of Classification Search
USPC ..... 100/229 A, 265, 283, 288; 53/390, 527; 220/908
See application file for complete search history.

(56) References Cited

U.S. PATENT DOCUMENTS

| | | | | |
|---|---|---|---|---|
| 1,190,393 | A | 7/1916 | Fields | |
| 4,275,651 | A * | 6/1981 | Groth | B30B 9/3053 100/226 |
| 5,115,736 | A | 5/1992 | Rodolico | |
| 8,001,887 | B2 * | 8/2011 | Harari | B65F 1/1405 100/229 A |
| 2005/0217512 | A1 | 10/2005 | Ruddock | |

FOREIGN PATENT DOCUMENTS

| | | | |
|---|---|---|---|
| JP | S592705 | U | 1/1984 |
| KR | 200436616 | Y1 | 10/2007 |

* cited by examiner

DEVICE FOR MANUALLY COMPACTING WASTE

This application is a U.S. national stage filing of International Application No. PCT/IB2015/0598866 filed on Dec. 22, 2015, which claims priority to European Application No. 14199963.1 filed on Dec. 23, 2014, the contents of each application incorporated herein by reference in their entirety.

TECHNICAL FIELD

The present invention relates to a device for manually compacting waste.

It is notably intended to allow household refuse to be compacted in domestic trashcans and in any other container containing recyclable waste.

PRIOR ART

At the present time it is customary for a private individual to be equipped with one or more domestic trashcans in which he places his various types of household waste. This type of domestic trashcan often takes the form of a cylindrical container, open at its upper end, and in which is placed a plastic bag intended to contain the waste. For ecological reasons, it is preferable to make optimum use of the internal volume of these plastic bags by attempting to compact the waste contained therein as far as possible. However, this compaction operation is not practical to perform because the user has to use his hands to press down on the top of the bag or on the waste, with a relatively high risk of dirtying his hands or even of injuring himself. Furthermore, depending on the type of waste, it is possible that this operation is not feasible. In particular, in the case of glass waste, compaction by hand is not to be performed.

DISCLOSURE OF THE INVENTION

The present invention therefore seeks to propose a device for compacting waste that makes it possible to overcome the aforementioned problems.

To this end, according to the invention, there is proposed a device for manually compacting waste contained in a container, comprising:

- a frame comprising a support plate intended to be placed on and/or fixed to the ground and two lateral uprights, respectively a left-hand lateral upright and a right-hand lateral upright, which are secured to said support plate and extend perpendicular thereto, said support plate and said lateral uprights delimiting a central space able to accept a container containing waste,
- two levers that can be operated by hand, namely a left-hand lever fixed pivotingly to the left-hand lateral upright about a left-hand axis of pivoting and a right-hand lever fixed pivotingly to the right-hand lateral upright about a right-hand axis of pivoting, said left-hand and right-hand axes of pivoting being parallel and defining a plane parallel to a plane defined by the support plate,
- at least one thrust bar to the lower end of which is fixed a compression plate, said thrust bar being connected to said left-hand and/or right-hand lever by means of at least one connecting means able to slide along said left-hand and/or right-hand lever and configured to act on said thrust bar under the action of said left-hand and/or right-hand lever so as to move it toward the ground or away from the ground, thus allowing the compression plate to be brought closer to and respectively further away from the support plate, from a position of equilibrium in which it rests on the waste that is to be compacted.

The device thus configured makes it possible to compact waste contained in a container placed beneath the compression plate, because of the downward thrust generated by the simultaneous lowering of the left-hand and right-hand levers and which is transmitted to the thrust bar or bars and to the compression plate secured thereto. This thrust compacts the waste into the bottom of the container. Moreover, because of the substantially symmetrical positioning of the left-hand and right-hand levers with respect to the thrust bar or bars and because of their opposing orientations, the effort provided by the user at the time of compaction is spread equally between the left-hand and right-hand lateral uprights, thus avoiding an unbalancing of the compacting device. Finally, the ability of the means of connection between the left-hand and/or right-hand lever and the thrust bar or bars to slide along said left-hand and/or right-hand lever prevents the thrust bar or bars from pivoting at the same time as this or these levers and allows the compression plate to be kept aligned with the container throughout compaction, making it far easier to compact the waste.

BRIEF DESCRIPTION OF THE DRAWINGS

Advantages and features of the present invention will be better understood from reading about a number of particular embodiments of the invention and from referring to the drawings in which.

DETAILED DESCRIPTION OF ONE EMBODIMENT OF THE INVENTION

Reference is made to FIGS. 1 and 2*a* to 2*c* which depict one embodiment of the device according to the present invention.

Figure 1:
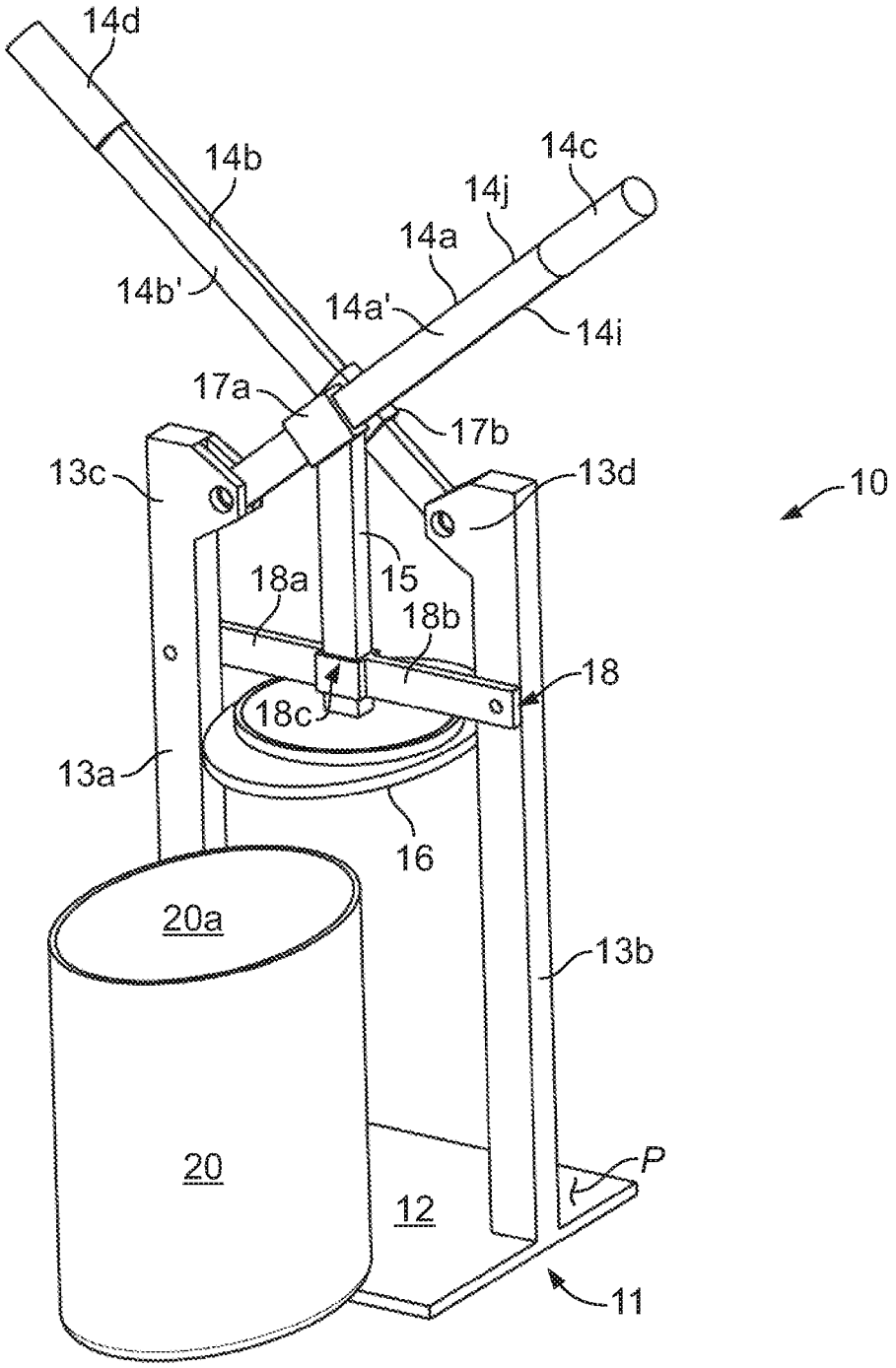
FIG. 1 depicts a perspective view of a first embodiment of a device according to the invention.
Figure 2A:
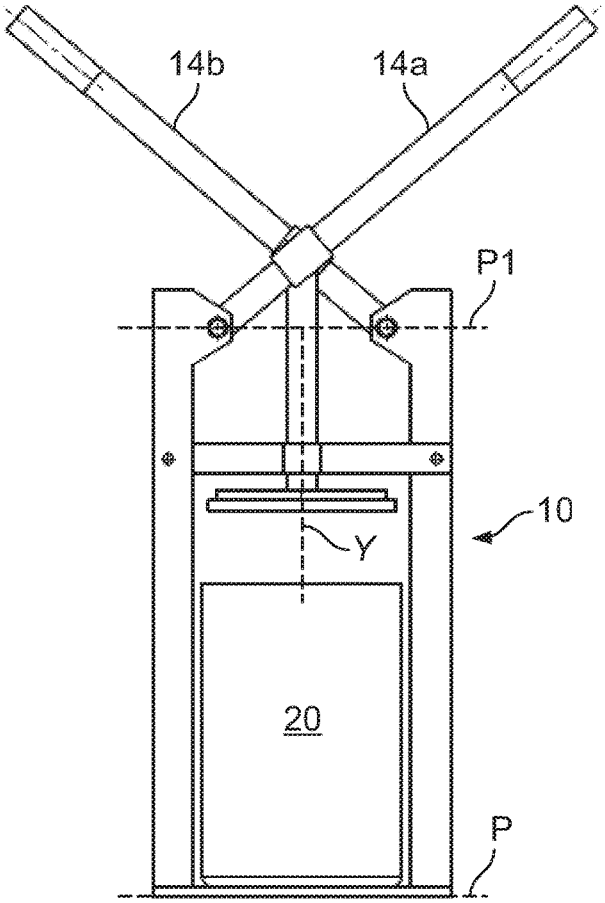
FIGS. 2*a*, 2*b* and 2*c* respectively depict face-on, side and plan views of the device depicted in FIG. 1.
Figure 2B:
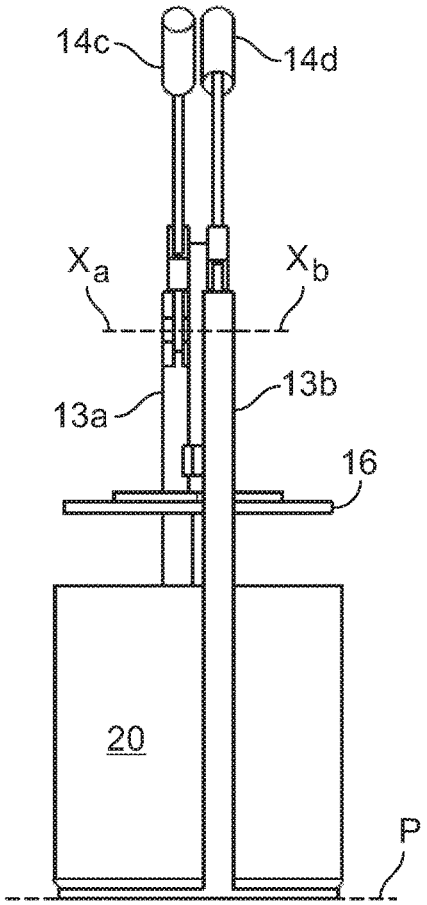
Figure 2C:
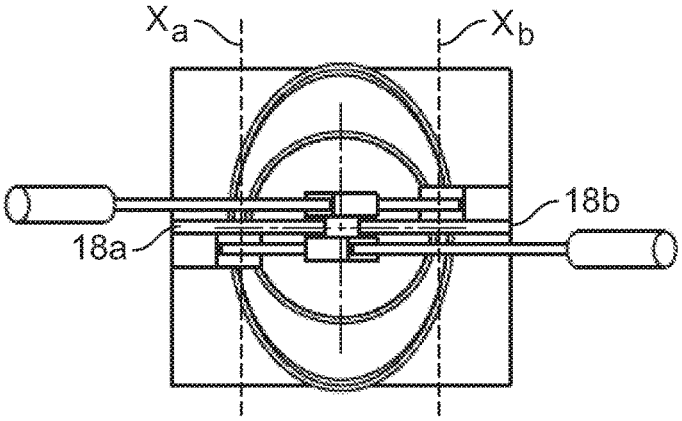
Figure 3A:
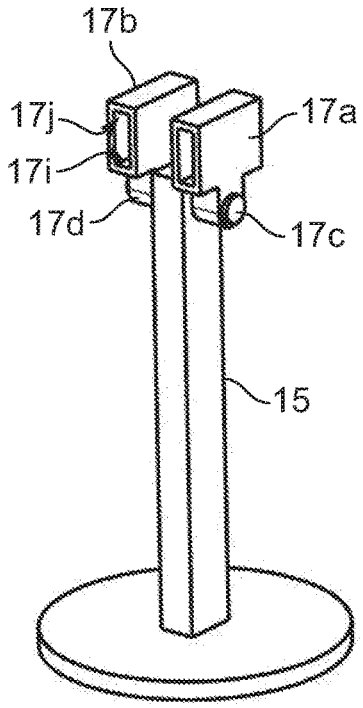
FIGS. 3*a* to 3*d* depict enlarged perspective views of several means of connection that can be used in the device of FIG. 1 for connecting the left-hand and right-hand levers to the thrust bar.

In this embodiment, the device 10 is formed of a frame 11 intended to be placed on and/or fixed to the ground. This frame 11 comprises a flat support plate 12 substantially defining a plane P, two lateral uprights, respectively a left-hand 13*a* and a right-hand 13*b* one, secured to said support plate and extending perpendicular to the plane P. The free space delimited by the lateral uprights 13*a*, 13*b* and by the support plate 12 is configured to accept a container 20 containing the waste that is to be compacted. In the alternative form depicted, this container 20 is cylindrical in shape, the base of the cylinder defining an ellipse. It is clear that other shapes are conceivable for the base. In particular, a base of rectangular, square or circular shape would be equally possible. The container 20 rests at its lower end on the support plate 12 and is open at its upper end 20*a* so as to allow the introduction of a compression plate intended to press down on the waste contained in the container as described in detail further on. Each lateral upright 13*a*, 13*b* is equipped at its upper end with a forked head 13*c*, 13*d* equipped with two parallel flat teeth, the intermediary space between said teeth being designed to accept the lower end of a left-hand 14*a* or right-hand 14*b* lever respectively, said levers 14*a*, 14*b* being fixed pivotingly to the left-hand and right-hand lateral uprights 13*a*, 13*b* respectively about left-hand and right-hand axes of pivoting Xa, Xb respectively, for example by means of a shaft fixed at its two ends to the teeth of the head 13*c*, 13*d* respectively. As depicted in FIG. 2*b*, the axes of pivoting Xa, Xb will advantageously be parallel to the plane P, the plane P1 defined by said axes being parallel to the plane P as depicted in FIG. 2*a*. In the position depicted in FIG. 1, the left-hand and right-hand levers 14*a*, 14*b* have been raised to the maximum extent under the effect of a manual pulling operation performed by the user on handles 14*c*, 14*d* arranged at the free end of the left-hand and right-hand levers respectively so that they extend obliquely from their point of attachment to their respective lateral upright upward and to the right, in the case of the left-hand lever 14*a*, and upward and to the left, in the case of the right-hand lever 14*b*. This results in a scissors arrangement of the two levers which ensures that the device has minimum bulk in the widthwise direction, namely in a direction perpendicular to the axes Xa and Xb and parallel to the plane P. The use of two levers also proves to be advantageous with respect to a single lever because it allows the effort applied by the user to be distributed over the two lateral uprights of the device. An alternative form with a single lever would thus have the disadvantage of transmitting this effort to either the left-hand or the right-hand upright alone, with a risk of unbalancing the device and potentially in certain circumstances resulting in breakage of the point of attachment of the lever to its upright. In the alternative form shown, this scissors arrangement of the levers 14*a*, 14*b* is, however, possible only if the left-hand and right-hand lateral uprights 13*a* and 13*b* are longitudinally offset, which means to say offset in a direction parallel to the axes Xa and Xb, as illustrated in FIGS. 2*b* and 2*c*. In the space separating the two levers 14*a*, 14*b* is housed a thrust bar 15 oriented perpendicular to the plane P, the direction Y defined by the thrust bar advantageously being kept equidistant from the axes Xa and Xb by means of a guide element 18. As illustrated in FIG. 1, the guide element 18 could notably consist of a hollow tubular element 18*c* inside which the thrust bar 15 slides, said hollow tubular element being connected to the left-hand 13*a* and right-hand 13*b* lateral uprights by a left-hand 18*a* and a right-hand 18*b* crossbar respectively. Fixed to the lower end of the thrust bar 15 is a compression plate 16 intended to be introduced into the container 20 as the thrust bar 15 gradually descends, thus compressing the waste contained inside said container. To this end, the compression plate 16 will advantageously have an external shape and size substantially identical to those of the base of the cylinder defined by the container so as to ensure uniform compression of all the waste. In the configuration depicted, this compression plate 16 has an external perimeter of oval shape the dimensions of which are slightly smaller than those of the upper opening 20*a* of the container 20. The thrust bar 16 is moreover connected at its upper end to the levers 14*a*, 14*b* by means of two connecting elements, a left-hand connecting element 17*a* and a right-hand connecting element 17*b* respectively. As illustrated in detail in FIG. 3*a*, each of the connecting elements 17*a*, 17*b* comprises a hollow tubular part of parallelepipedal shape inside which one of the levers slides, namely the left-hand lever 14*a* sliding inside the left-hand connecting element 17*a*, and the right-hand lever 14*b* sliding inside the right-hand connecting element 17*b*, said levers preferably having a rectangular cross section that complements that of the hollow tubular part. Said tubular part is connected pivotingly to the thrust bar 15 by means of a pin 17*c* housed inside a substantially cylindrical part 17*d* secured to the tubular part, said pin 17*c* defining a direction parallel to the axes Xa and Xb. The positioning of the cylindrical part 17*d* could be variable. In particular, as depicted in FIG. 1, this cylindrical part could advantageously be positioned inside the thrust bar 15 thus limiting the heightwise size of the device. Configured in this way, the connecting elements 17*a*, 17*b* are able to transfer the pivoting of the left-hand and right-hand levers 14*a*, 14*b* as a downward or upward movement of the thrust bar 15 and, therefore, of the compression plate 16 secured thereto, thus allowing the waste contained in the container 20 to be compacted.

Figure 5A:
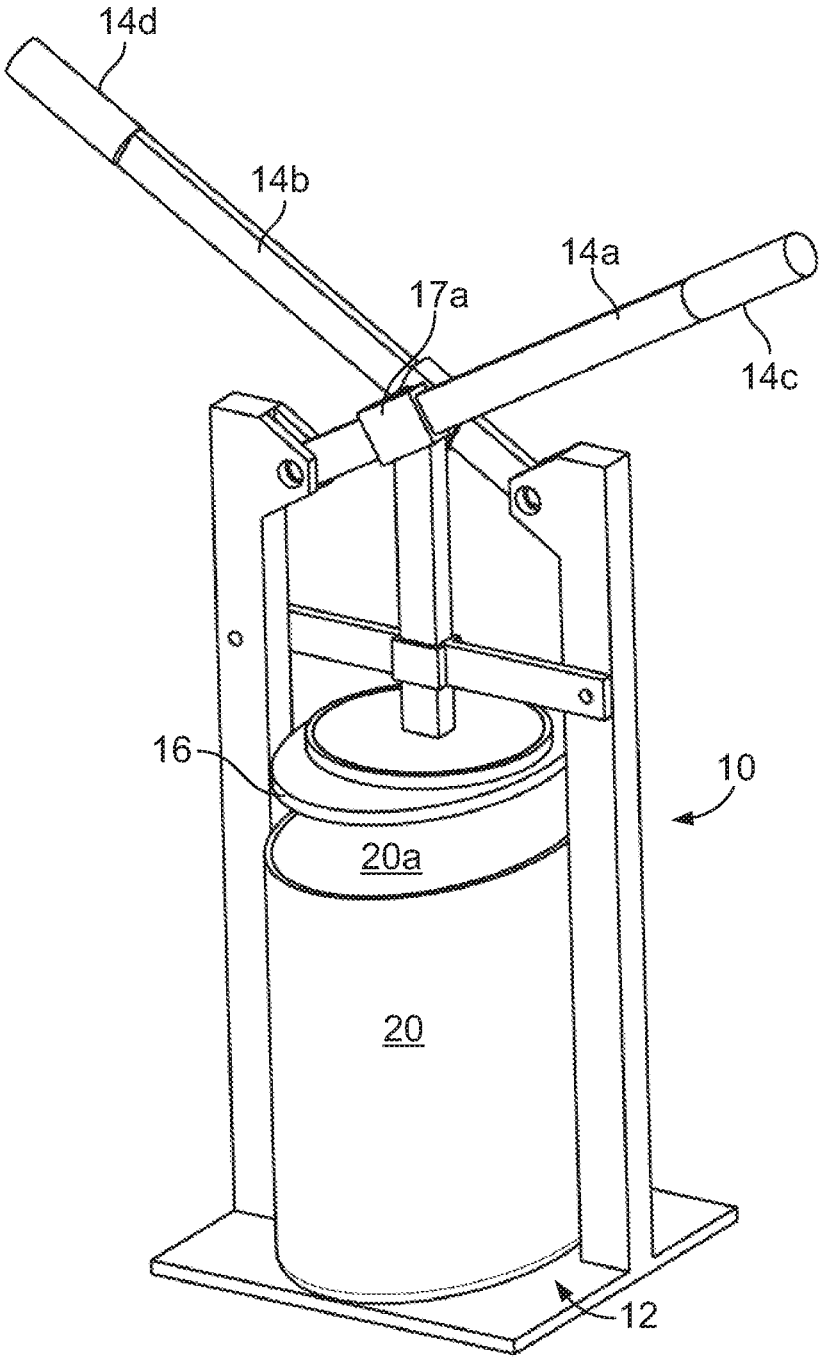
FIGS. 5*a* to 5*d* depict perspective views of the device depicted in FIG. 1 as the operation of compacting the waste gradually progresses.
Figure 5B:
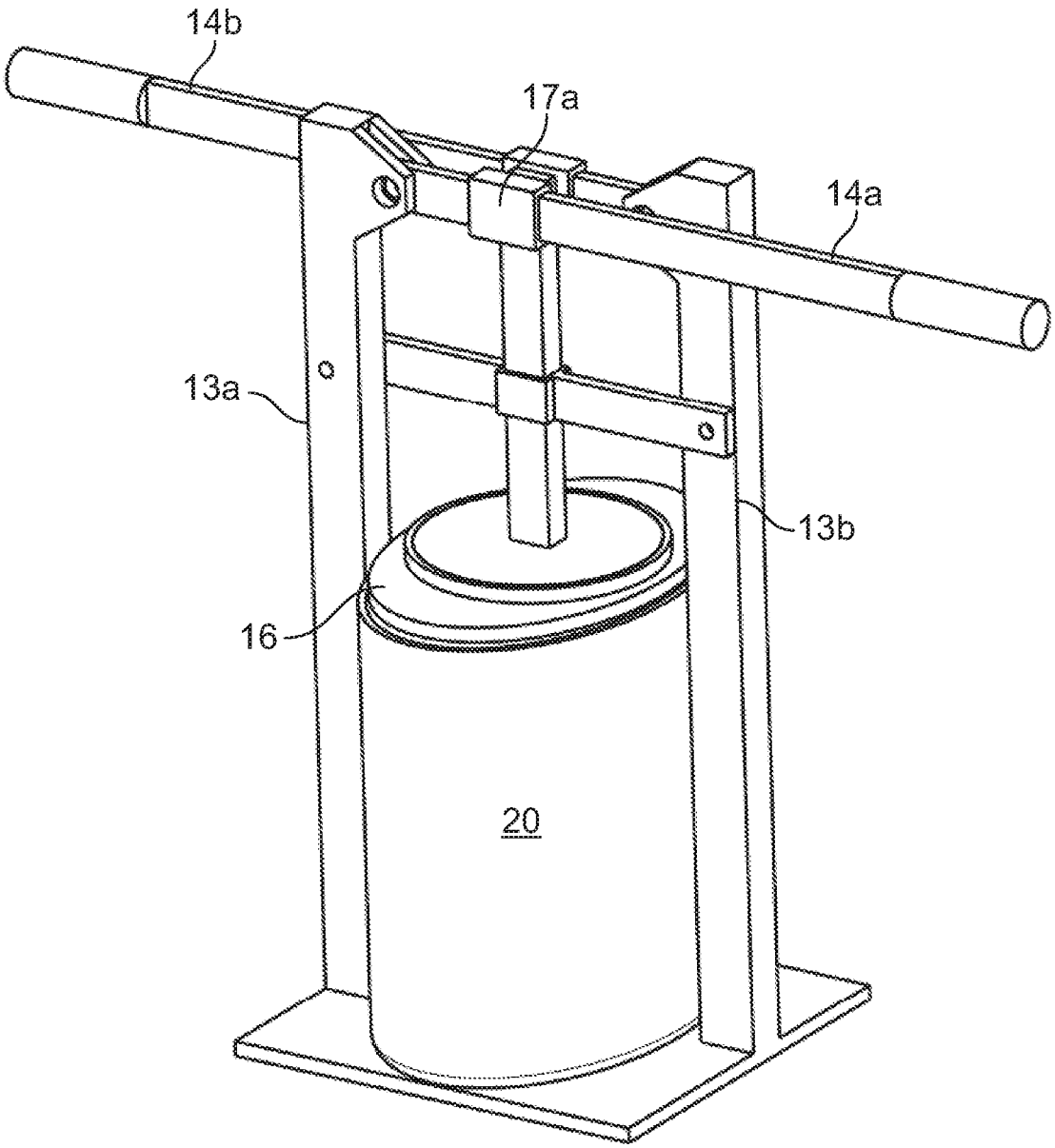
Figure 5C:
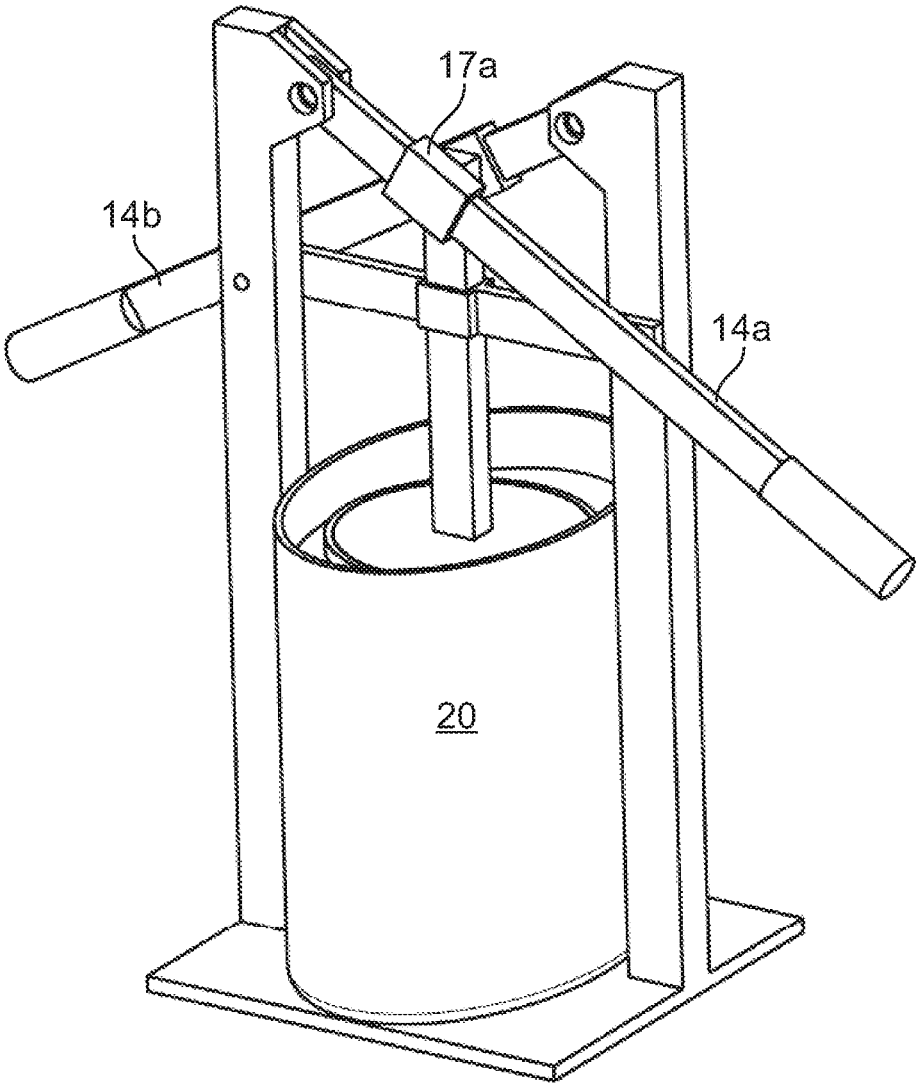
Figure 5D:
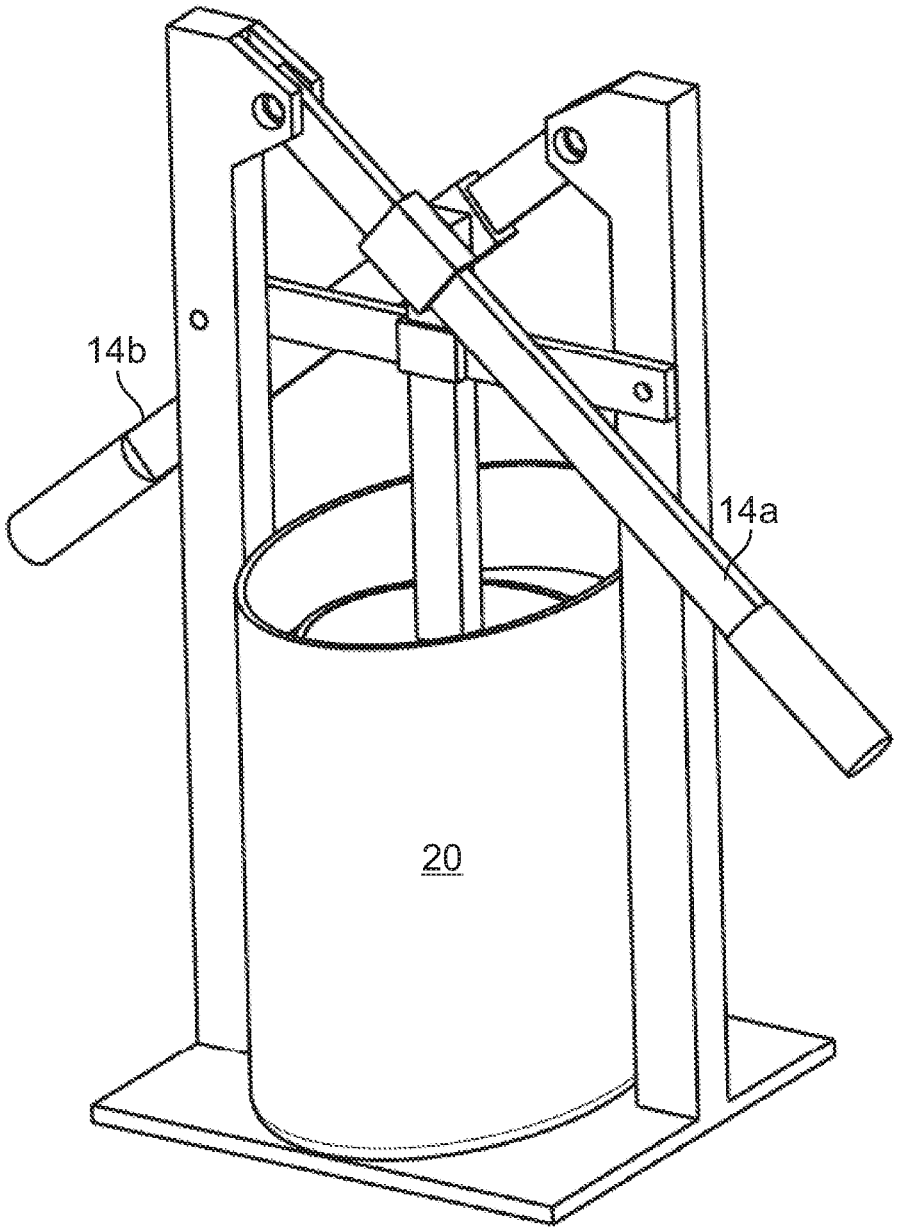

The proper compacting operation is illustrated in FIGS. 5*a* to 5*d*. In the position depicted in FIG. 5*a*, the compression plate 16 is kept in a raised position above the support plate 12 by the upward thrust applied by hand by the user to the handles 14*c*, 14*d* of the left-hand 14*a* and right-hand 14*b* levers respectively. This raised position opens up enough space between the compression plate 16 and the support plate 12 for a container 20 completely full of waste to be positioned therein, the waste coming all the way up to the upper end 20*a* of the container 20. Starting from this raised position, the compression plate 16 is progressively lowered until it presses down on the top of the waste, in the position of equilibrium depicted in FIG. 2*b*. In this position, the weight of the compression plate 16, of the thrust bar 15, of the connecting elements 17*a*, 17*b* and of the levers 14*a*, 14*b* is compensated for by the resistance of the waste to compression. It will be advantageous for such a position of equilibrium to correspond to the particular position depicted in FIG. 5*b*, in which the levers 14*a* and 14*b* are substantially aligned in the plane P1 defined by the axes of pivoting Xa and Xb. In order to compact the waste further, the user will then need to act on the handles 14*c* and 14*d* to cause a downward inclination of the levers 14*a*, 14*b*. During this movement, the lower edge 14*i* of each of the left-hand and right-hand levers comes to bear on a lower internal edge 17*i* of the hollow tubular part of the left-hand and right-hand connecting elements, thus causing the thrust bar and the compression plate secured thereto to move downward. This downward movement therefore causes a compaction of the waste in the container 20. The degree of this compaction will be dependent on the force applied by the user. FIGS. 5*c* and 5*d* in particular illustrate two specific positions of the levers 14*a* and 14*b* and of the compression plate 16 respectively for moderate compaction and for a relatively high degree of compaction of the waste. Once the compaction has been performed, the user will act on the handles 14*c* and 14*d* to return the levers 14*a* and 14*b* to the raised position depicted in FIG. 5*a*, thus allowing the container containing the compacted waste to be removed and potentially replaced with a container containing waste that has not been compacted. Thus, by raising the handles 14*c* and 14*d* the user will bring about an upward inclination of the left-hand and right-hand levers 14*a*, 14*b* in such a way that the upper edge 14*j* of each of the levers comes to bear on the upper internal edge 17*j* of the hollow tubular part of the left-hand and right-hand connecting elements 17*a*, 17*b*, thus causing the thrust bar and the compression plate secured thereto to move upward. During these upward and downward movements of the levers 14*a*, 14*b*, the left-hand and right-hand connecting elements 17*a*, 17*b* slide along their respective lever while pivoting about the pin 17*c*. That allows the thrust bar 15 to be kept in alignment with the hollow tubular element 18*c* throughout the upward and downward movement of the compression plate 16.

Figure 3B:
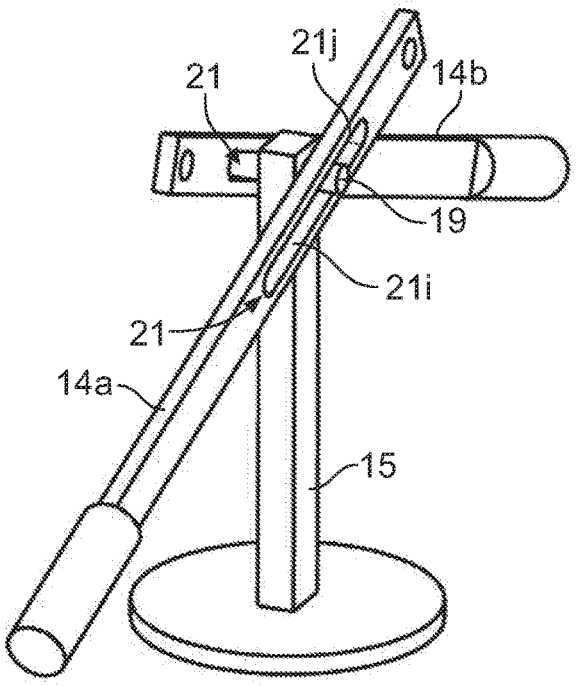
Figure 3C:
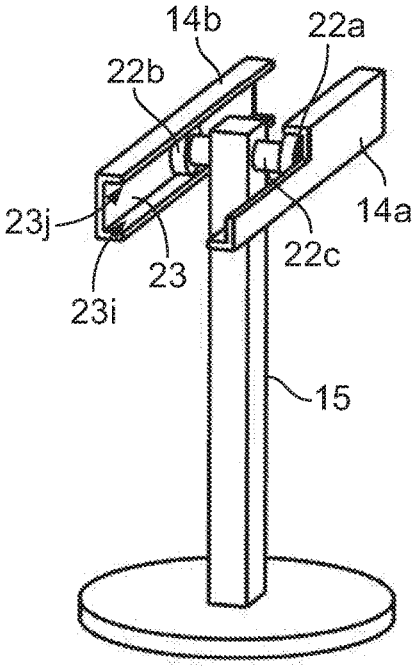
Figure 3D:
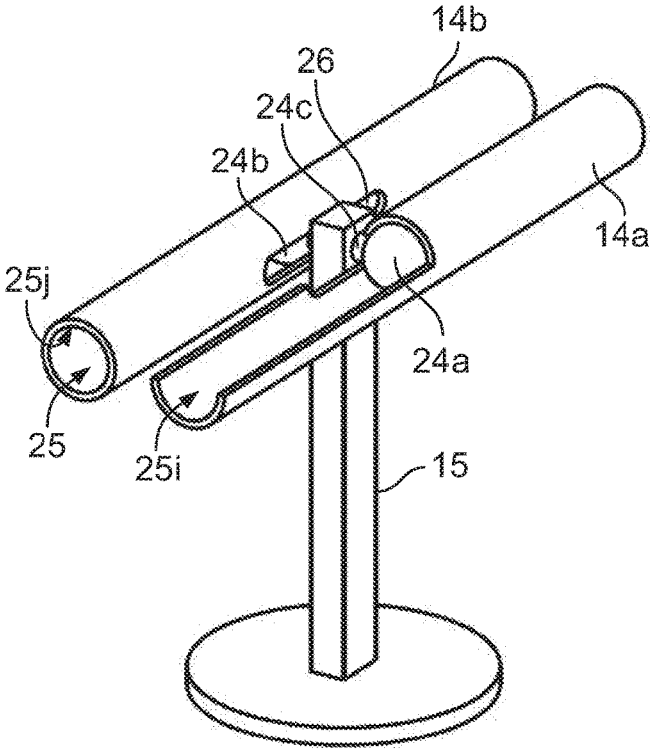

Three possible alternative forms of embodiment of the left-hand and right-hand connecting elements described hereinabove are depicted in FIGS. 3*b*, 3*c* and 3*d*.

In the alternative form of FIG. 3*b*, a single connecting element is used to connect the left-hand 14*a* and right-hand 14*b* levers to the thrust bar 15. This connecting element takes the form of a tubular rod 19 oriented parallel to the left-hand Xa and right-hand Xb axes of pivoting and fixed to the thrust bar 15 in such a way as to have a projecting part on two opposite sides of said thrust bar. The projecting parts of the rod 19 slide inside a slot 21 provided inside each of the left-hand and right-hand levers. Thus, during the downward and respectively upward pivoting of the levers 14*a*, 14*b* about their respective axis of pivoting, an upper edge 21*j* and respectively a lower edge 21*i* of the slot 21 comes to bear on the rod 19, thus causing the thrust bar 15 to move downward and respectively upward, causing the rod 19 to slide along the slots 21 of the levers 14*a*, 14*b*.

In the alternative form of FIG. 3*c*, the left-hand and right-hand connecting elements each comprise a roller 22*a*, 22*b* of cylindrical shape connected pivotingly to the thrust bar 15 by means of a shaft 22*c*, each of the rollers being arranged inside an internal housing 23 of substantially parallelepipedal shape of the left-hand or right-hand lever, said shaft sliding inside a slot (not depicted) provided inside said left-hand or right-hand lever. Thus, during the downward and respectively upward pivoting of the levers 14*a*, 14*b* about their respective axis of pivoting, an upper edge 23*j* and respectively a lower edge 23*i* of the internal housing 23 comes to bear on the rollers 22*a*, 22*b*, thus causing the thrust bar 15 to be moved downward and respectively upward, and causing the rollers 22*a*, 22*b* to slide along the respective internal housing of the levers 14*a*, 14*b*.

The alternative form in FIG. 3*d* is relatively similar to the alternative form in FIG. 3*c*. This alternative form is adapted to the circular tubular cross-sectional shape of the levers 14*a*, 14*b*. As a result, the left-hand and right-hand connecting elements take the form of rollers 24*a*, 24*b* of spherical shape sliding inside an internal housing 25 of tubular shape, the pin 24*c* connecting the rollers 24*a* and 24*b* itself sliding in a slot 26 formed along each of the levers 14*a*, 14*b*. Thus, during the downward and respectively upward pivoting of the levers 14*a*, 14*b* about their respective axis of pivoting, an upper hemispherical edge 25*j* and respectively a lower hemispherical edge 25*i* of the internal housing 25 comes to bear on the rollers 24*a*, 24*b*, thus causing the thrust bar 15 to move downward and respectively upward, and causing the rollers 24*a*, 24*b* to slide along the respective internal housing of the levers 14*a*, 14*b*.

Figure 4:
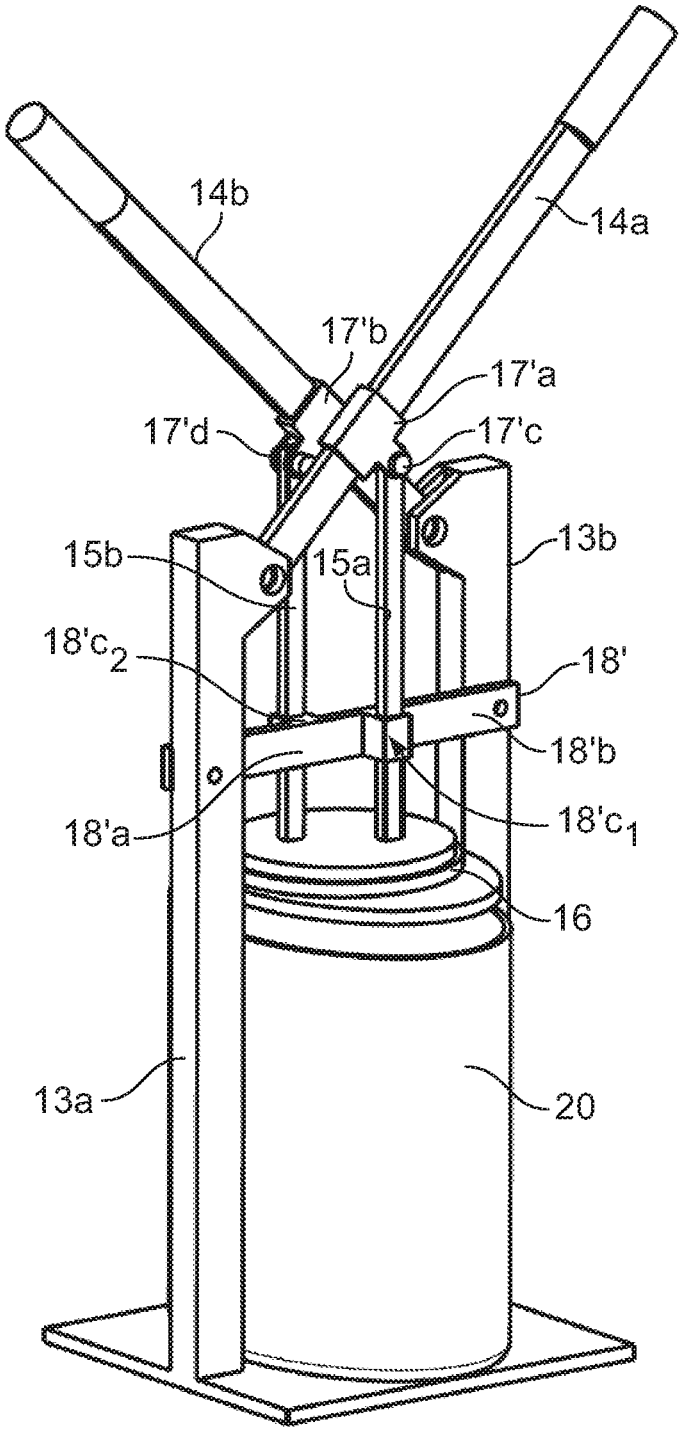
FIG. 4 depicts a perspective view of a second embodiment of a device according to the invention.

Reference is made to FIG. 4 which depicts a second possible embodiment for the compacting device according to the present invention.

In this embodiment, each of the left-hand 14*a* and right-hand 14*b* levers is connected to the compression plate 16 by means of a distinct thrust bar, namely a left-hand thrust bar 15*a* and respectively a right-hand thrust bar 15*b*, which is connected fixedly at its lower end to the compression plate 16 and connected at its upper end to the left-hand lever 14*a* and respectively right-hand lever 14*b* by a left-hand connecting element 17'*a* and respectively a right-hand connecting element 17'*b*, said connecting elements being relatively similar to those used in the alternative form of FIG. 1.

Thus, each of the left-hand and right-hand connecting elements 17'*a* and 17'*b* comprises a hollow tubular part of parallelepipedal shape inside which one of the levers slides, namely the left-hand lever 14*a* sliding inside the left-hand connecting element 17'*a*, and the right-hand lever 14*b* sliding inside the right-hand connecting element 17'*b*, said levers preferably having a rectangular cross section that complements that of the hollow tubular part. The tubular part of the left-hand connecting means 17'*a* and respectively right-hand connecting means 17'*b* is connected pivotingly to the left-hand 15*a* and respectively right-hand 15*b* thrust bar by means of a pin 17'*c*, and respectively 17'*d*, housed inside a through hole formed at the end of said left-hand 15*a* and respectively right-hand 15*b* thrust bar, and fixed at its two ends to a fork-shaped extension secured to the tubular part, said pin 17'*c*, respectively 17'*d*, defining a direction parallel to the axes of pivoting Xa and Xb of the levers 14*a* and 14*b*.

Configured in this way, the connecting elements 17'*a*, 17'*b* are able to transfer the pivoting of the left-hand and right-hand levers 14*a*, 14*b* as a downward or upward movement of the thrust bars 15*a* and 15*b* respectively and, as a result, of the compression plate 16 secured thereto, thus allowing waste contained in the container 20 to be compacted. The thrust bars 15*a*, 15*b* will advantageously be guided in their translational movement in a direction perpendicular to the axes Xa and Xb by means of a guide element 18'. As illustrated in FIG. 1, this guide element 18' may notably consist of a left-hand hollow tubular element 18'$c_1$ inside which the left-hand thrust bar 15*a* slides and of a right-hand hollow tubular element 18'$c_2$ inside which the right-hand thrust bar 15*b* slides, said hollow tubular elements 18'$c_1$ and 18'$c_2$ being connected to the left-hand 13*a* and right-hand 13*b* lateral uprights by a left-hand 18'*a* and a right-hand 18'*b* crossbar respectively.

In another alternative form (not depicted) of the invention, the compression plate could be fixed removably to the lower end of the thrust bar or bars. In that way, the device of the present invention will be able to be adapted to suit the size and shape of the container containing the waste and/or the type of waste contained in said container. Thus, in the configuration depicted in FIG. 1, compression plates of square, rectangular or round external shape could be fixed in place of the oval shaped plate.

Moreover, it will be advantageous also to equip the left-hand and right-hand levers (14*a*, 14*b*) with an extendable or removable part (14*a*', 14*b*') so as to allow them to be lengthened or shortened. This extendable part (14*a*', 14*b*') may advantageously be mounted telescopically or foldingly on a central part of said left-hand and right-hand levers (14*a*, 14*b*).

The invention claimed is:

1. A device for manually compacting waste contained in a container, comprising:

a frame comprising a support plate configured to be placed on and/or fixed to the ground and two lateral uprights, including a left-hand lateral upright and a right-hand lateral upright, which are secured to said support plate and extend perpendicular thereto, said support plate and said lateral uprights delimiting a central space to accept a container containing waste, two levers that can be operated by hand, including a left-hand lever fixed pivotingly to the left-hand lateral upright about a left-hand axis of pivoting and a right-hand lever fixed pivotingly to the right-hand lateral upright about a right-hand axis of pivoting, said left-hand and right-hand axes of pivoting being parallel and defining a plane parallel to a plane defined by the support plate, and at least one thrust bar having a lower end that is fixed to a compression plate, said thrust bar being connected to said left-hand and/or right-hand lever by at least one connecting means able to slide along said left-hand and/or right-hand lever and configured to act on said thrust bar under an action of said left-hand and/or right-hand lever so as to move said compression plate toward the ground or away from the ground, thus allowing the compression plate to be brought closer to and respectively further away from the support plate, from a position of equilibrium in which the compression plate rests on the waste that is to be compacted.

2. The device as claimed in claim 1, further comprising guide means able to guide a translational movement of said thrust bar in a direction perpendicular to the plane defined by the support plate.

3. The device as claimed in claim 2, wherein said guide means comprise a hollow tubular element inside which said thrust bar slides, said hollow tubular element being connected to the left-hand and right-hand lateral uprights by left-hand and right-hand crossbars, respectively.

4. The device as claimed in claim 2, wherein the guide means are configured to guide the translational movement of the thrust bar in a direction that is equidistant from the left-hand and right-hand axes of pivoting of the left-hand and right-hand levers.

5. The device as claimed in claim 1, wherein the connecting means comprises a tubular rod oriented parallel to the left-hand and right-hand axes of pivoting and fixed to the thrust bar in such a way as to have a projecting part on two opposite sides of said thrust bar, said projecting parts sliding inside a slot provided inside each of the left-hand and right-hand levers, an upper edge and respectively a lower edge of said slot coming to bear on said rod when said left-hand and right-hand levers are lowered and respectively raised from the position of equilibrium of the compression plate, thus causing the thrust bar to move downward and respectively upward, and causing the tubular rod to slide along the slots of the left-hand and right-hand levers.

6. The device as claimed in claim 1, wherein the at least one connecting means comprises two connecting means, including a left-hand connecting means and a right-hand connecting means, which are connected pivotingly to the thrust bar about one and the same central pivot pin which is parallel to the left-hand and right-hand axes of pivoting, each of the connecting means comprising a hollow tubular part inside which one of the left-hand or right-hand levers slides, a lower edge and respectively an upper edge of said left-hand or right-hand lever coming to bear on a lower internal edge and respectively an upper internal edge of said hollow tubular part when said left-hand or right-hand lever is lowered and respectively raised from the position of equilibrium of the compression plate, thus causing the thrust bar to move downward and respectively upward, and causing the hollow tubular part to slide along the left-hand or right-hand lever.

7. The device as claimed in claim 1, wherein the at least one connecting means comprises two connecting means, including a left-hand connecting means and a right-hand connecting means, each of the connecting means comprising a roller connected pivotingly to the thrust bar by a pin and arranged inside an internal housing of the left-hand or right-hand lever, said pin sliding along a slot Response to Non-Final Office Action in said left-hand or right-hand lever, an upper edge and respectively a lower edge of said internal housing coming to bear on said roller when said left-hand or right-hand lever is lowered and respectively raised from the position of equilibrium of the compression plate, thus causing the thrust bar to move downward and respectively upward, and causing the roller to slide along the internal housing of the left-hand or right-hand lever.

8. The device as claimed in claim 7, wherein the roller is configured as a cylinder, and the internal housing has a parallelepipedal shape.

9. The device as claimed in claim 7, wherein the roller has a spherical shape and in that the internal housing has a tubular shape.

10. The device as claimed in claim 1, wherein the at least one thrust bar comprises two thrust bars, including a left-hand thrust bar connected to the left-hand lever by a left-hand connecting means and a right-hand thrust bar connected to the right-hand lever by a right-hand connecting means, said left-hand and respectively right-hand connecting means being able to slide along said left-hand and respectively right-hand lever and being configured to act on said left-hand and respectively right-hand thrust rod under the action of said left-hand and respectively right-hand lever so as to move said compression plate toward the ground or away from the ground.

11. The device as claimed in claim 10, wherein the left-hand and respectively right-hand connecting means is connected pivotingly to the left-hand and respectively right-hand thrust bar about a left-hand and respectively right-hand central pivot pin which is parallel to the left-hand and respectively right-hand axis of pivoting, each of the left-hand and right-hand connecting means comprising a hollow tubular part inside which the left-hand or right-hand lever slides, a lower and respectively upper edge of said left-hand or right-hand lever coming to bear on a lower and respectively upper internal edge of said hollow tubular part when said left-hand or right-hand lever is lowered and respectively raised from the position of equilibrium of the compression plate, thus causing the left-hand or right-hand thrust bar to move downward and respectively upward, and causing the hollow tubular part to slide along the left-hand or right-hand lever.

12. The device as claimed in claim 1, wherein the compression plate has an external perimeter of oval shape.

13. The device as claimed in claim 1, wherein the compression plate is fixed removably to the lower end of the thrust bar in such a way that the compression plate can easily be modified according to the size and shape of the container containing the waste and/or according to the type of waste contained in said container.

14. The device as claimed in claim 1, wherein the left-hand and right-hand levers are provided with an extendable part ora removable part so as to allow them to be lengthened or shortened.

15. The device as claimed in claim 14, wherein the extendable part is mounted telescopically or foldingly on a central part of said left-hand and right-hand levers.

* * * * *